US006340225B1

(12) United States Patent
Szlucha

(10) Patent No.: US 6,340,225 B1
(45) Date of Patent: Jan. 22, 2002

(54) CROSS FLOW AIR SYSTEM FOR INK JET PRINTER

(75) Inventor: Thomas F. Szlucha, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/232,640

(22) Filed: Jan. 19, 1999

(51) Int. Cl.[7] ..... B41J 2/01
(52) U.S. Cl. ..... 347/102; 101/424.1
(58) Field of Search ..... 347/102, 104, 347/105; 346/140 R, 25, 24; 101/424.1, 487, 488, 416.1

(56) References Cited

U.S. PATENT DOCUMENTS

| | | | | |
|---|---|---|---|---|
| 4,970,528 A | | 11/1990 | Beaufort et al. | |
| 4,982,207 A | | 1/1991 | Tunmore et al. | |
| 5,005,025 A | | 4/1991 | Miyakawa et al. | |
| 5,029,311 A | | 7/1991 | Brandkamp et al. | |
| 5,274,400 A | | 12/1993 | Johnson et al. | |
| 5,287,123 A | | 2/1994 | Medin et al. | |
| 5,296,873 A | * | 3/1994 | Russell et al. | 346/22 |
| 5,317,127 A | * | 5/1994 | Brewster, Jr. et al. | 219/388 |
| 5,406,321 A | | 4/1995 | Schwiebert et al. | |
| 5,589,866 A | * | 12/1996 | Russell et al. | 347/102 |
| 5,742,315 A | * | 4/1998 | Szlucha et al. | 347/102 |
| 5,754,208 A | | 5/1998 | Szlucha | |
| 6,048,059 A | * | 4/2000 | Wafler | 347/102 |
| 6,048,060 A | * | 4/2000 | Narushima et al. | 347/104 |
| 6,059,406 A | * | 5/2000 | Richtsmeier et al. | 347/102 |

* cited by examiner

*Primary Examiner*—John S. Hilten
*Assistant Examiner*—Darius N. Cone
(74) *Attorney, Agent, or Firm*—Oliff & Berridge, PLC

(57) ABSTRACT

A printing machine for printing on a recording medium moving along a path through a print zone, includes a printhead, adapted to deposit ink on the recording medium in the print zone; and a cross flow blower disposed adjacently to the path and at a position in the path prior to the print zone, wherein the cross flow blower creates an air flow in the path from at least a position just before the print zone to a position at least just after the print zone.

13 Claims, 2 Drawing Sheets

CROSS FLOW AIR SYSTEM FOR INK JET PRINTER

BACKGROUND OF THE INVENTION

1. Field of Invention

This invention relates generally to a liquid ink printing apparatus, and more particularly to a liquid ink printing apparatus having a cross flow air system for drying a recording medium and ink deposited on the recording medium.

2. Description of Related Art

Liquid ink printers of the type frequently referred to as continuous stream or as drop-on-demand, such as piezoelectric, acoustic, phase change wax-based or thermal printer, have at least one printhead from which droplets of ink are directed towards a recording medium. Within the printhead, the ink is contained in at least one channel, or preferably in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in one of the plurality of channels. As voltage is applied across a selected resistor, a vapor bubble grows in the associated channel and initially bulges from the channel orifice, followed by collapse of the bubble. The ink within the channel then retracts and separates from the bulging ink, to form a droplet moving in a direction away from the channel orifice and towards the recording medium. When the ink droplet hits the recording medium, a drop or spot of ink is deposited. The channel is then refilled by capillary action, which, in turn, draws ink from a supply container of liquid ink.

The ink jet printhead may be incorporated into either a carriage type printer, a partial-width-array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage, which is reciprocated to print one swath of information (having a width equal to the length of a column of nozzles) at a time on a stationary recording medium, such as paper or a transparency. After the swath is printed, the paper is stepped a distance equal to the height of the printed swath or a portion of the swath, so that the next printed swath is contiguous or overlapping with the previously printed swath. This procedure is repeated until the entire page is printed. In contrast, the page-width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks, and particularly those used in thermal ink jet printing, include a colorant or dye and a liquid, which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types, which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning the recording medium typically prepares the recording medium for receiving ink by driving out excess moisture, which can be present in a recording medium such as paper. Not only does this preconditioning step reduce the amount of time necessary to dry the ink once it is deposited on the recording medium, but this preconditioning step also improves image quality by reducing paper cockle and curl, which can result from too much moisture remaining in the recording medium.

Various drying mechanisms for drying images deposited on recording mediums are illustrated and described in the following disclosures, which may be relevant to certain aspects of this invention.

U.S. Pat. No. 4,970,528 to Beaufort et al., describes a method for uniformly drying ink on paper from an ink jet printer. The printer includes a uniform heat flux dryer system including a 180° contoured paper transport path for transferring paper from an input supply tray to an output tray. During transport, the paper receives a uniform heat flux from an infrared bulb located at the axis of symmetry of the paper transport path. Reflectors are positioned on each side of the infrared bulb to maximize heat transmission from the bulb to the paper during the ink drying process.

U.S. Pat. No. 5,029,311 to Brandkarnp et al., describes a fluorescent lamp utilized in a document scanning system that is environmentally and thermally stabilized by means of a bifurcated heater control assembly. A heater blanket is wrapped around the entire surface of the lamp, including the end areas surrounding the filaments but exclusive of the aperture through which light is emitted.

U.S. Pat. No. 5,274,400 to Johnson et al. describes an ink path geometry for high temperature operation of ink jet printheads. A heating means is positioned close to a print zone for drying of the print medium. The heating means includes a print heater and a reflector, which serve to concentrate the heat on the bottom of the print medium through a screen.

U.S. Pat. No. 5,287,123 to Medin et al. describes a color ink jet printer having a heating blower system for evaporating ink carriers from the print medium after ink-jet printing. A print heater halogen quartz bulb heats the underside of the medium via radiant and convective heat transfer through an opening pattern formed in a print zone heater screen.

U.S. Pat. No. 4,982,207, to Tunmore et al. describes a heater construction for an ink jet printer having a rotary print platen for holding and transporting a print sheet through a print path. The platen heater includes a hollow shell having vacuum holes for sheet attachment. A heating foil is detachably mounted in a heat transfer relation with the interior periphery of the shell.

U.S. Pat. No. 5,005,025, to Miyakawa et al. describes an inkjet recording apparatus for recording, which fixes ink through evaporation of an ink solvent. The apparatus includes a heating member extending both upstream and downstream with respect to a recording area and a conveying direction of the recording sheet. The heating member contacts the recording sheet to assist in fixing the ink.

U.S. Pat. No. 5,406,321, to Schwiebert et al. describes an ink jet printer and a paper preconditioning preheater for the ink jet printer. The paper preconditioning preheater has a curved surface and a multi-purpose paper path component to accomplish direction reversal for the paper. The paper contacts the preheater, which dries and shrinks the paper to condition it for a printing operation. The preheater is a thin flexible film carrying heater elements that is suspended in air to provide extremely low thermal mass and eliminate the need for long warm up times.

SUMMARY OF THE INVENTION

Despite these various designs, a need exists for an ink jet printer dryer system that efficiently works to dry printed substrates. This need is particularly evident in the field of color ink jet printing, where one color printed area must be dried, either partially or completely, prior to printing with a second color. Such a system is required in order to prevent inter-color bleed, a problem that results when a subsequently printed color bleeds into a previously printed color, or vice-versa, causing a print image defect. That is, when two colors are printed in sequence, either on top of or adjacent to one another, the colors will unintentionally mix with each other if there is insufficient drying of the first printed color prior to printing the second color. This creates a gross deficiency in the print quality, affecting the sharpness of the edges and the overall resolution of the image.

Furthermore, the need exists in the field for improved active drying systems for ink jet printing applications. As the print speed, color range and ink coverage of ink jet printers increases, the need for active drying mechanisms in the printers also increases. An aspect of such active drying systems is airflow through the printer, and particularly through the recording medium path (i.e, the transport path and the print zone). Airflow is important because it serves at least two functions in the printer. First, airflow assists in the evaporation of the liquid carrier from the printed ink to dry the printed image, permitting faster handling of the printed materials. Second, airflow can provide a cooling effect to the printhead, which tends to reduce thermally driven density variations in the ink resulting from printhead temperature changes. Furthermore, positive airflow through the printer has the additional effect of removing effluents, by-products produced during rapid drying of the liquid inks. These by-products otherwise tend to condense on cooler surfaces, which could lead to contamination on the recording medium, paper handling difficulties, or end-user disapproval.

Furthermore, a need exists for printer dryer designs that will efficiently and quickly dry the printed image without causing image or paper defects. Such printer dryer designs will permit still higher increases in paper throughput speed, permitting higher speed printing.

This invention provides an active drying system incorporating a cross flow air system that realizes improved drying of the printed recording medium and of the printer components.

This invention especially provides an active drying apparatus having a cross flow air system that can be incorporated into a printing apparatus, such as an ink jet printer.

The cross flow air system of this invention provides higher printing efficiency, higher print quality, and lower cost.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Although the cross flow air system of this invention discussed herein may be used for drying any image that is created by a liquid ink printer, the description of the cross flow air system of this invention will be described in the environment of a liquid ink printer such as that shown in FIG. 1.

Figure 1:
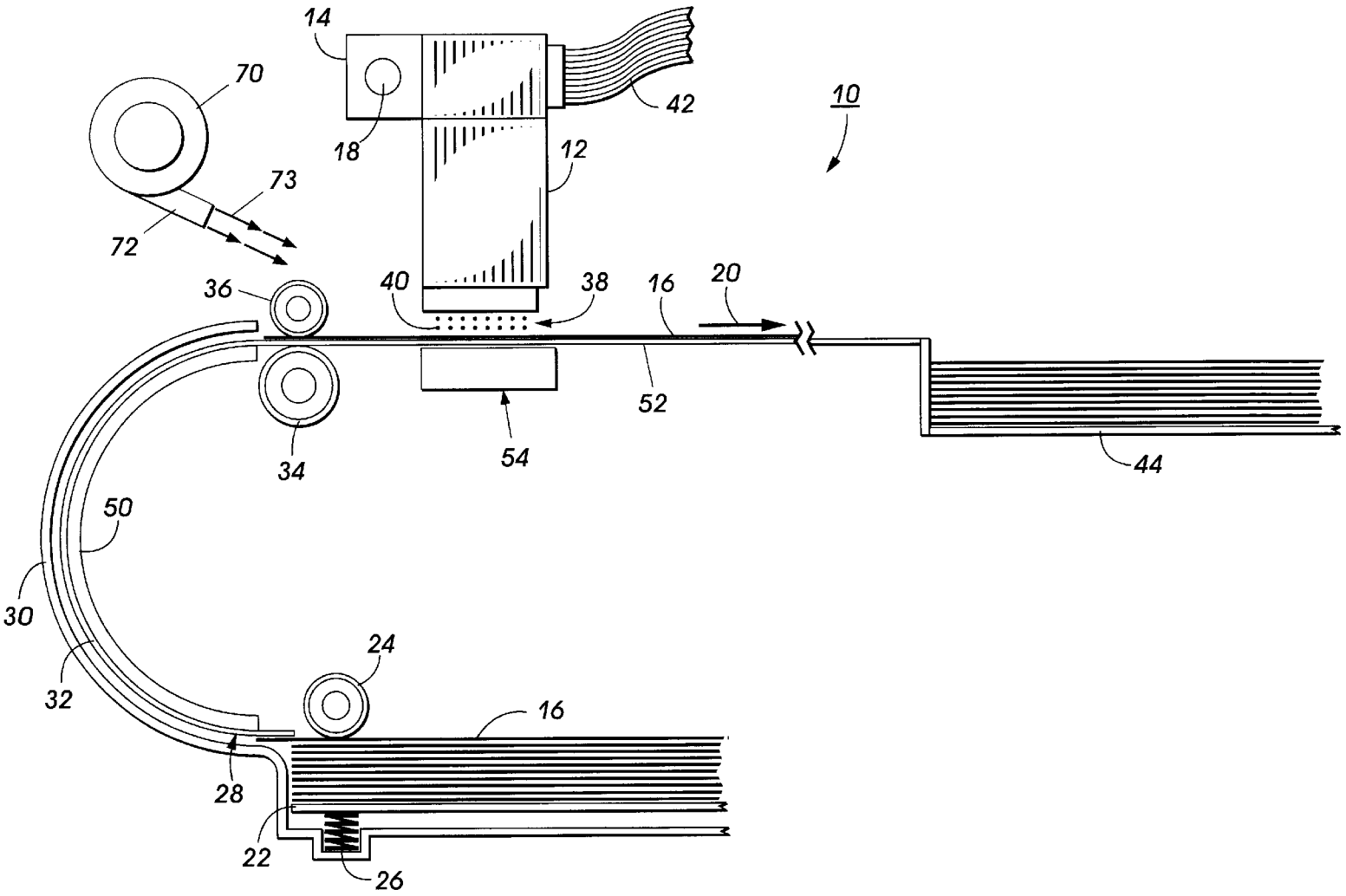
FIG. 1 illustrates an exemplary printer design according to the present invention.

FIG. 1 illustrates a schematic representation of a liquid ink printer 10 in a side elevation view. A translating ink jet printhead 12 printing black and/or colored inks is supported by a carriage 14, which moves back and forth across a recording medium 16, for instance, a sheet of paper or a transparency, on a guide rail 18. Multiple printheads (not shown) printing different colors, or a full-width printbar (not shown) printing one or more colors, can also be used with the liquid ink printer 10. The recording medium 16 moves along a recording medium path through the liquid ink printer 10 in the direction noted by the arrow 20. Single sheets of the recording medium 16 are fed from a supply tray 22 by a document feed roll 24. The document tray 22 is spring biased by a biasing mechanism 26, which forces the top sheet of the stack of recording media 16 held by the tray 22 into contact with the feed roll 24. The topmost recording medium 16, in contact with the drive roll 24, is transported by the drive roll 24 into a chute 28. The chute 28 is defined by an outer guide member 30 spaced from an inner guide member 32, each of which are curved to reverse the direction of the recording sheets 16 for printing by the printhead 12. Once the recording medium exits the chute 28, the recording medium 16 is driven by a drive roll 34 cooperating with a pinch roll 36 to advance the recording sheet 16 into a print zone 38.

The print zone 38 is the area directly beneath the printhead 12 where droplets of ink 40 are deposited by an array of ink nozzles arranged on a front face of the printhead 12 to print a swath of information. The front face of the printhead 12 is substantially parallel to the recording medium 16. The carriage 14, traveling orthogonally to the recording medium 16, deposits the ink droplets 40 upon the recording medium 16 in an imagewise fashion. The printhead 12 receives ink from either an attached ink tank or from an ink supply tube (not shown). The image deposited upon the recording medium 16 can include text and/or graphic images, the creation of which is controlled by a controller, known to those skilled in the art, in response to electrical signals traveling through a ribbon cable 42 coupled to the printhead 12. Before the recording medium 16 has completely left control of the drive roll 34 and the pinch roll 36, an exit drive roll/pinch roll combination (not shown), or other known or later developed device, captures the leading edge of the recording medium 16 for transport to an output tray 44, which holds printed recording medium.

To fix the liquid ink to the recording medium 16, the moisture must be driven from the ink and the recording medium 16. While it is possible to dry the ink by natural air drying, natural air drying can create certain problems such as cockle or curl and can also reduce the printing throughput of the liquid ink printer 10. Consequently, active drying by the application of heat energy to the printed recording medium is preferred. Active drying by various dryer mechanisms and various dryer designs is known in the art, and such dryer designs can be varied based on the particular printer design, the amount of drying necessary, and whether a predryer apparatus is included in addition to a primary dryer apparatus. In the cross flow air system of this invention, the type and structure of the active drying mechanism is not particularly important nor particularly limited, so long as the dryer dries the printed image.

Thus, for example, any of the various drying mechanisms described above, with reference to U.S. Pat. No. 4,970,528 to Beaufort et al., U.S. Pat. No. 5,029,311 to Brandkamp et al., U.S. Pat. No. 5,274,400 to Johnson et al., U.S. Pat. No. 5,287,123 to Medin et al., U.S. Pat. No. 4,982,207 to Tunmore et al., U.S. Pat. No. 5,005,025 to Miyakawa et al., and U.S. Pat. No. 5,406,321 to Schwiebert et al. can be used with the cross flow air system of this invention. The entire disclosures of these references are incorporated herein by reference.

Figure 2:
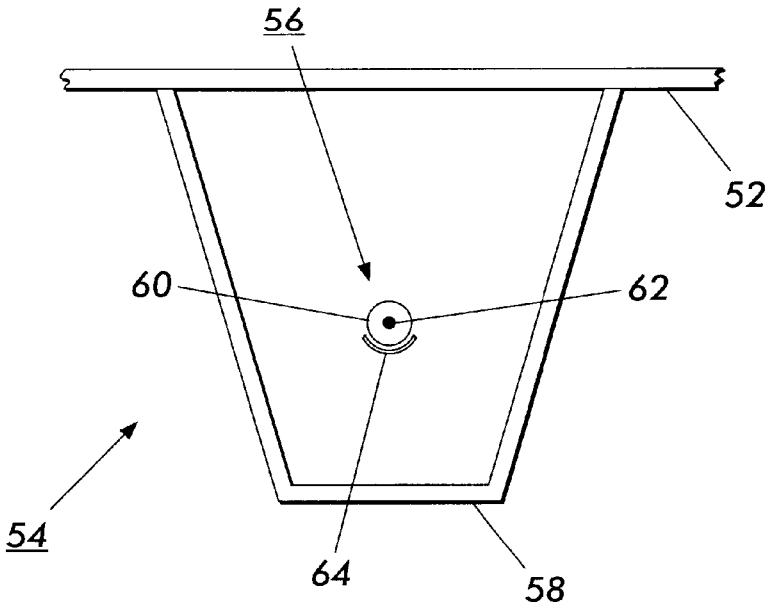
FIG. 2 is a schematic diagram of one exemplary embodiment of the cross flow air system of this invention.

Thus, although not limited to any particular dryer design, drying a printed image using the cross flow air system will be described with reference to two exemplary embodiments of the cross flow air system. FIG. 2 is a cross-sectional view of a dryer device suitable for use with one exemplary embodiment of the cross flow air system of this invention. Once the leading edge of the recording medium 16 has passed into the print zone 38, ink is deposited on the recording medium in the print zone 38. During traversal through the print zone 38, the recording medium 16 is supported in the print zone 38 by a support platen 52 that defines a substantially planar surface with apertures (not shown). Beneath the support platen 52 is a dryer 54, which applies heat energy to the back side of the recording medium 16 during printing. The dryer 54 drives the liquid from the ink deposited by the printhead. The dryer 54 primarily adds heat energy to the recording medium during printing to drive excess liquid from the ink and paper.

The heater 54 includes a heater lamp 56 located within a reflector housing 58. The heater lamp 56 includes a quartz tube 60 surrounding a resistive filament wire 62, such as iron-aluminum chromium or nickel chromium alloy. The quartz tube 60 surrounding the filament wire 62 prevents the filament wire 62 from contacting other printer components and is a high temperature material to prevent breakage. The spiral wound resistive filament wire 62 in the quartz tube 60 includes a length approximately equal to the width of the recording sheet 16 such that the heat energy generated by the filament wire 62 is applied sufficiently across the width of the recording sheet 16 as it passes through the print zone 38. Tungsten iodide lamps can also be used as the heater lamp 56.

The heat energy generated by the heater lamp 56 is directed towards the backside of the recording medium 16 by the reflector housing 58, and more importantly an integral reflector 64 located on the exterior surface of the quartz tube 60. The integral reflector 64 is a highly reflective coating, such as gold, which has been deposited upon substantially the entire length of the quartz tube 60 and on approximately 180° of the circumference of the quartz tube 60. The highly reflective coating 64 directs the radiant energy or heat energy generated by the heater lamp 56 efficiently onto the recording medium 16.

The reflective coating 64 is deposited on the outer circumference of the quartz tube 60 by known vacuum deposition techniques. While gold is preferred because of its high reflectivity, silver and other known reflective materials can also be used. The described tube lamp configuration increases the efficiency of the dryer 54 when used in combination with the reflector housing 58, both of which direct heat energy to the same side of the recording medium 16. Applying the coating 64 of the highly reflective material to a portion of the quartz tube 60 acts as a very efficient reflector to direct radiant energy towards the print zone 38. The reflector housing 58, consequently, receives much less of the direct radiant energy from the lamp, resulting in lower reflector losses. For example, the energy losses resulting from the absorption by a reflector alone are much greater than energy losses resulting from a reflector with the described heater lamp having the integral reflective coating.

Figure 3:
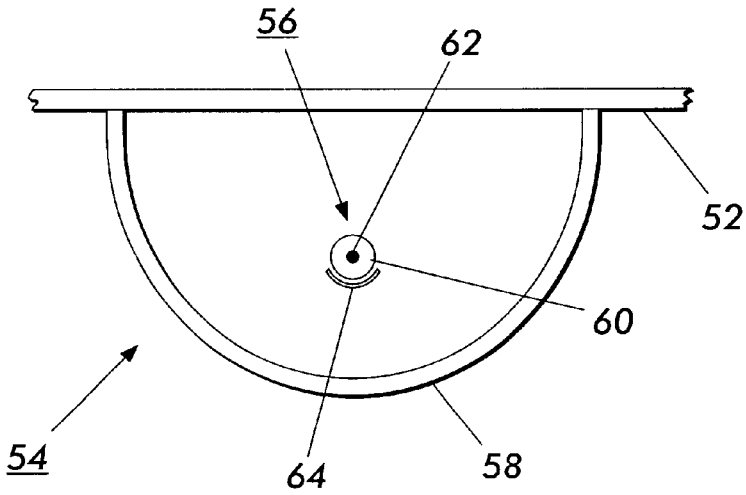
FIG. 3 is a schematic diagram of a second exemplary embodiment of the cross flow air system of this invention.

FIG. 3 shows a modification of the dryer design of FIG. 2. FIG. 3 is a cross-sectional view of a dryer device suitable for use in other embodiments of the exemplary cross flow air system of this invention. In the dryer device of FIG. 3, the heater 54 includes an elliptical reflector housing 58.

Furthermore, as described above, using preheating stations has been found to advantageously effect print quality output. Thus, in exemplary embodiments of the cross flow air system of this invention, a preheater unit can also be included in the printer design, generally to preheat the recording medium 16 during its traversal from the supply tray to the print zone. Suitable preheating units are disclosed in, for example, U.S. Pat. No. 5,754,208 and copending application Ser. No. 09/236,553 filed concurrently herewith, the entire disclosures of which are incorporated herein by reference. Of course, other preheater designs can be utilized in the cross flow air system of this invention.

Although the above description of the heating apparatus has been with reference to a heater system placed on an opposite side of the recording medium from the side of the recording medium being printed (i.e., on the backside of the recording medium), such an arrangement is not necessary in all embodiments of the present invention. In particular, if desired, heating can suitably be applied to the side of the recording medium which is to receive the printed image, based on only routine modifications that will be apparent to those skilled in the art.

To improve printing quality, the cross flow air system of this invention blows air in a cross flow manner across the print zone 38. That is, the cross flow air system blows air in a path coextensive with the path of the recording medium 16 through the print zone 38.

FIG. 1 shows one exemplary embodiment of the cross flow air system. In FIG. 1, the cross flow air system is generally implemented by incorporating a blower fan 70 into the liquid ink printer 10. The blower fan 70 generally takes in ambient air and blows the air through an exhaust port 72, or other similar device, to concentrate the air flow into the print zone 38. Thus, the air flow generally represented by the arrows 73 will contact the recording medium 16 after it exits the chute 28. The air flow then continues through the print zone 38 and exits the liquid ink printer 10 through an outlet (not shown). In so doing, the air flow both (1) assists the positive drying of the ink deposited on the recording medium 16, (2) assists in cooling printer components such as the printhead, and (3) removes effluents from the liquid ink printer 10.

In this exemplary embodiment, the blower fan 70 is preferably an elongated blower fan. Typically, the elongated blower fan 70 will have a length of about the same width as the width of the recording medium being used. Thus, for typical office and home applications where paper widths of up to 8.5 inches are used, the blower fan will have a length of about 8.5 inches. The exhaust venting of the blower fan 70 should preferably be designed to provide a uniform air flow stream from one end of the print width to the other. Of course, as will be apparent to one of ordinary skill in the art, blower fans 70 of shorter or longer dimensions can be used. In such instances, either the exhaust venting of the blower fan 70 can be adjusted to provide a uniform air flow, or a non-uniform air flow can be used. Furthermore, it is apparent that multiple blower fans of shorter widths can be used in place of a single full-width blower fan, if desired.

Furthermore, in the exemplary embodiments of the cross flow air system of this invention, the blower fan 70 is located near the entrance of the print zone. Although the location of the blower fan 70 is not critical, if the blower fan 70 is further removed from the print zone, the desired effects of drying, cooling and effluent removal are decreased. Furthermore, the blower fan 70 is preferably located within the liquid ink printer 10, so that air can be drawn into the fan directly from outside the liquid ink printer 10. However, the blower fan 70 can also be located further inside the liquid ink printer 10. In such instances, the blower fan 70 is preferably connected to an intake area within an outer housing of the liquid ink printer 10, preferably by suitable ducts, so that ambient air can be drawn into the blower fan 70 from outside the liquid ink printer 10.

Once the air flow has passed through the print zone 38, the air is preferably exhausted out of the printer housing. Such exhausting can be conducted with suitable ducts and vents, as will be readily apparent to one of ordinary skill in the art. If desired, a filter can be incorporated into the exhaust ducts to remove effluents, dust or other particles.

The operation of the blower fan 70 can be controlled by suitable control means (not shown) such that the fan is switched on and off, and its operational speed is varied, based on the relative location of the recording medium 16 to the print zone 38. Thus, for example, in some embodiments of the cross flow air system, the fan may only be operated when the recording medium 16 is in the print zone 38, to conserve energy used by the blower fan motor. Similarly, the heater device can also be controlled by the same or different controller system to control the heat output based on the presence or absence of a recording medium 16 in the print zone 38. As will be apparent, the control of the fan can be on-and-off, where the fan is switched on to a preset speed when the recording medium 16 reaches a first preset location in the paper path and is then switched off when the recording medium 16 reaches a second preset location in the paper path.

Alternatively, the blower fan speed can be varied based on the relative location of the recording medium 16. For example, the blower fan can be controlled to be turned on to a low speed when the leading edge of the recording medium 16 reaches the print zone 38. The fan speed can slowly be increased as the recording medium 16 occupies more of the print zone 38, and then retained at the maximum speed until the recording medium 16 begins to exit the print zone 38. As the recording medium 16 exits the print zone 38, the blower fan speed can be decreased, and then shut off either when or after the recording medium 16 fully exits the print zone 38. The advantages of such speed control is that when the recording medium 16 is not fully covering the print zone 38, the fan 70 does not blow excessive amounts of air into a dryer device located in the print zone 38, thus avoiding over cooling the print heater and cavity and reducing the amount of heat energy available to evaporate the ink carrier.

Furthermore, as is known in the art, the fan speed, or at least a maximum fan speed, must be controlled based on the particular print medium and ink characteristics. That is, the maximum fan speed is determined by ink spray conditions on the recording media. The fan speed should be maximized to keep the ink cartridges and printer enclosure from getting too hot. However, the air velocity creates ink spray outside the nominal print area, as tiny spray droplets are forced away from major ink drops ejected by the printhead. The visual threshold acceptability of ink spray depends on the medium type. Thus, plain paper is least sensitive to ink spray, and therefore the highest fan speed setting can be used for plain paper. However, a lower maximum fan speed can be used for other types of recording media that are more sensitive to ink spray, and which use a lower heater setting and have less need for cooling.

In embodiments of the present invention, the air flow rate from the blower fan can be adjusted as desired to provide the desired drying effect. As is known in the art, the air flow rate can vary from one specific application to another, based on such factors as specific type of recording medium being used, type of ink being used, level of drying required of the blower fan system, and print speed. Thus, for example, in embodiments of the present invention, it is suitable for the blower fan to have an air flow rate of from about 35 to about 55 CFM (cubic feet per minute), such as about 46 CFM.

As will be apparent to one of ordinary skill in the art, numerous fan and duct configurations can be used with the cross flow air system of this invention, and the cross flow air system is no way limited to the specific exemplary embodiments described above. One skilled in the art will recognize that the various aspects of the printer apparatus discussed above may be selected and adjusted as necessary to achieve specific results for a particular printer application. Thus, the foregoing embodiments are intended to illustrate and not limit the cross flow air system of this invention. It will be apparent that various modifications can be made without departing from the spirit and scope of the invention.

What is claimed is:

1. A printing machine for printing on a recording medium moving along a path through a print zone, comprising:

a printhead adapted to deposit ink on the recording medium in the print zone; and a cross flow blower disposed adjacently to the path and at a position in the path prior to the print zone, wherein the cross flow blower creates an air flow in the path from at least a position just before the print zone to a position at least just after the print zone.

2. The printing machine of claim 1, wherein the cross flow blower comprises a fan.

3. The printing machine of claim 2, wherein the cross flow blower further comprises a duct connecting the fan to a position adjacent the path and prior to the print zone.

4. The printing machine of claim 2, wherein the cross flow blower further comprises a vent located between the fan and a position adjacent the path and prior to the print zone.

5. The printing machine of claim 2, wherein the cross flow blower further comprises a duct connecting the fan to an outer housing of the printing machine.

6. The printing machine of claim 2, wherein the cross flow blower further comprises a vent located between the fan and an outer housing of the printing machine.

7. The printing machine of claim 1, further comprising a control system that controls the cross flow blower based on a relative position of a recording medium in the path.

8. The printing machine of claim 7, wherein the control system increases an air flow output from the cross flow blower as a leading edge of a recording medium enters the print zone.

9. The printing machine of claim 7, wherein the control system decreases an air flow output from the cross flow blower as a trailing edge of a recording medium exits the print zone.

10. The printing machine of claim 1, further comprising a heater located adjacent the path at a position across the print zone from the printhead.

11. The printing machine of claim 1, wherein the air flow is sufficient to concurrently dry ink deposited on a recording medium by the printhead, cool the printhead, and remove effluents from the printing machine.

12. A method for printing an image using the printing machine of claim 1, the method comprising:

feeding the recording medium into the path;

depositing ink on the recording medium in the print zone using the printhead; and directing the air flow from the cross flow blower along the path and over the deposited ink in a direction of movement of the recording medium.

13. A printing machine for printing on a recording medium moving along a path through a print zone, comprising:

printing means for depositing ink on the recording medium in the print zone; and dryer means, disposed adjacently to the path, for drying ink deposited on the recording medium and for creating an air flow in the path from at least a position just before the print zone to a position at least just after the print zone and in a direction of movement of the recording medium.

* * * * *